US006683264B2

(12) United States Patent
Obara et al.

(10) Patent No.: US 6,683,264 B2
(45) Date of Patent: Jan. 27, 2004

(54) LOW PROFILE KEY SWITCH STRUCTURE

(75) Inventors: Rikuro Obara, Kitasaku-Gun (JP); Masamitsu Osada, Kanagawa-Ken (JP); Masayuki Yoneyama, Kanagawa-Ken (JP)

(73) Assignee: Minebea Co., Ltd., Nagano-Ken (JP)

( * ) Notice: Subject to any disclaimer, the term of this patent is extended or adjusted under 35 U.S.C. 154(b) by 0 days.

(21) Appl. No.: 10/408,061

(22) Filed: Apr. 4, 2003

(65) Prior Publication Data

US 2003/0188961 A1 Oct. 9, 2003

(30) Foreign Application Priority Data

Apr. 4, 2002 (JP) ..... 2002-102559

(51) Int. Cl.[7] ..... H01H 13/70
(52) U.S. Cl. ..... 200/344; 200/341; 200/292
(58) Field of Search ..... 200/341, 342, 200/343, 344, 292, 512–517, 242, 253, 245, 5 A; 400/491.1, 491.2, 491, 495, 496, 490; 361/687, 688, 680

(56) References Cited

U.S. PATENT DOCUMENTS 4,046,981 A * 9/1977 Johnson et al. ..... 200/516
4,580,018 A * 4/1986 Yoshihara ..... 200/5 A
5,504,283 A * 4/1996 Kako et al. ..... 200/5 A
5,512,719 A * 4/1996 Okada et al. ..... 200/344
5,767,468 A * 6/1998 Tsai ..... 200/344
6,072,133 A * 6/2000 Takagi et al. ..... 200/344
6,107,584 A * 8/2000 Yoneyama ..... 200/344
6,172,868 B1 * 1/2001 Oura ..... 361/680
6,268,578 B1 * 7/2001 Nakai ..... 200/520
6,597,344 B1 * 7/2003 Narusawa et al. ..... 345/168

* cited by examiner

*Primary Examiner*—Elvin Enad
*Assistant Examiner*—Lisa Klaus
(74) *Attorney, Agent, or Firm*—Schulte Roth & Zabel LLP; Joel E. Lutzker, Esq.; Lisa M. Knight, Esq.

(57) ABSTRACT

This low profile key switch structure provides a substantial reduction in the height or thickness of a key switch as compared to conventional and other low profile switches. Substantial height reduction in key switch structures allows the size and thickness of notebook-type personal computers and the like to be similarly reduced. One feature of this low profile key switch structure is that unlike in conventional key switch structures the membrane switch and frame structures do not over lap to cause unnecessary height in the structure. Another feature of this key switch structure is that the frames are formed to include the free motion range limiters. The frames are further formed so that they may be embedded in the reinforcing base plate in such a manner that allows the height of the key switch to be further reduced. This low profile key switch structure is also designed to eliminate unwanted key top movement that often occurs in conventional and other switches when the key top is depressed.

19 Claims, 6 Drawing Sheets

LOW PROFILE KEY SWITCH STRUCTURE

CROSS-REFERENCE TO RELATED APPLICATIONS

This application claims priority from Japanese application serial no. 2002-102559, filed Apr. 4, 2002.

BACKGROUND OF THE INVENTION

1. Field of the Invention

The present invention relates to a key switch structure for use in computer keyboards. More particularly, the present invention pertains to a thin-form key switch structure that is suitable for use in thin notebook-type personal computers or other low profile computers.

2. Description of the Prior Art

With the advent and popularity of thin, lightweight notebook-type personal computers, manufacturers have continuously sought to further reduce the size, weight and thickness of such computers. The size, height and weight of the key switches that are positioned under each keytop contribute significantly to the size and weight of notebook computers. Thus, manufacturers have attempted to achieve such reductions by developing thin-forming or low profile key switches. However, there are several constraints that make further reduction of the height and weight of the key switch very difficult. For example, for optimal operability a minimum keystroke length of 2.6 to 2.7 is required as well as a certain click sensation. Under such constraints, any significant additional height or weight reduction of key switches cannot be achieved using the conventional switches.

The key switch disclosed in JP Patent 2001-14083 is an example of a key switch which retains a fixed keystroke and click sensation. The main portions of this key switch are as shown, for example, in the vertical cross sections depicted in FIGS. 5 and 6 as well as in the stabilizer section of a conventional key switch as depicted in FIG. 7. FIG. 5 shows the key switch of Section A—A of FIG. 7 in the OFF state. FIG. 6 shows the same key switch but from a perspective of Section B—B of FIG. 7 and in the ON state.

Referring to the key switch of depicted in FIG. 5, the key switch structure is comprised of reinforcing base plate 1, membrane switch 2 disposed on reinforcing base plate 1, frame 3 on membrane switch 2, stabilizer 4, key top 5, and click rubber 6 sandwiched between the membrane switch 2 surface and the key top 5 bottom surface. Membrane switch 2 includes two (flexible film) layers 8 and 9. Membrane switch 2 further includes spacer 7 that is positioned between membrane layers 8 and 9. Electrical contact 10 and electrical circuits are provided on the opposing surfaces of membrane layers 8 and 9. Hole 11 is an opening in spacer 7 at the location of the electrical contact 10. When membrane layer 8 is pushed downward in the area above electrical contact 10 membrane layer 8 is distorted downward placing electrical contact 10 in the ON state.

As shown in FIG. 7, stabilizer 4 is affixed on each of the left and right sides of the click rubber 6 (left and right as seen from the key switch operating position). Two long and narrow flat pieces 15 and 16 are arranged to form X-shaped part 18. Flat pieces 15 and 16 may be made from a rigid material such as metal, hard plastic or the like. Stabilizer 4 formed as X-shaped part 18 is linked at an intermediary point by a support axis 17 allowing stabilizer 4 to have a variable crossing angle $\alpha$. Slider 20 is circular and perpendicularly protrudes from the bottom end of each X-shaped part 18. Four sliding portions or sliders 20*a*–20*d* are contained in a free-fitting state within the square-shaped free motion range limiter 13 respectively located at four points around the hole 12 in frame 3.

The width W of the free motion range limiter 13 described above is slightly greater than the width of the slider 20. The length of free motion range limiter 13 must be relatively substantial in order to allow the bottom of key top 5 to make contact with the top surface of frame 3. Thus, slider 20 is able to move freely while sliding on the surface of membrane layer 8 within free motion range limiter 13. A stopper (not shown) projects over free motion range limiter 13 that contains slider 20, such that the slider 20 does not jump out of free motion range limiter 13.

Frame 3 identified above is affixed to the top of membrane switch 2 and has a flat shape. Hole 12 is an opening in frame 3 that is positioned above electrical contract 10 of membrane switch 2. Moreover, in addition to free motion range limiter 13, there is a slit shaped storage hole 21 for the X-shaped part that connects two free motion range limiters 13 on each side of click rubber 6. More specifically, X-shaped part storage hole 21*a* connects the two free motion range limiters 13 on one side of click rubber 6 and X-shaped part storage hole 21*b* connects the two free motion range limiters 13 on the other side of click rubber 6, as shown in FIG. 7. There is also a notch in storage hole 21 at the position at which stabilizers 4 are linked.

As shown in FIGS. 5–7, slider 22 is circular and protrudes perpendicularly from the both top ends of each X-shaped part 18. As shown in FIG. 5, slider 22 loosely fits within the horizontal part of L-shaped engagement piece 23 that is disposed at the four corners of the bottom surface of key top 5. The distance between hanging portion 24 on the side of key top 5 and the vertical portion of engagement piece 23 is sufficiently greater than the diameter of slider 22. This distance allows slider 22 to move freely between hanging portion 24 and vertical portion of engagement piece 23 while sliding on the bottom surface of key top 5 or on the horizontal portion of engagement piece 23.

X-shaped part 18 is linked to frame 3 and key top 5 so as to be able to move freely within a fixed range on the surface that contains it. The arrangement, dimensions, and shape of each of the parts which control the range of play are selected so that sliders 20 and 22 have a predetermined positional relationship to free movement range limiters 13 when key top 5 is in the OFF or normal state and in the ON or compressed state.

This prior art key switch design, however, has several disadvantages. As shown in FIG. 6, key top 5 may be depressed so that X-shaped part 18 is compressed until the crossing angle $\alpha$ is 180 degrees and key top 5 cannot be depressed further. At this point, lower end slider 20 of X-shaped part 18 is in a position whereby it contacts free motion range limiter 13 outside wall surface 13*b*, and top end slider 22 is in a position whereby it contacts key top 5 side hanging portion 24. As a result, further displacement is prevented and key top 5 is stopped at that position.

While the height reduction technique for the prior art key switch described above has affected the size and weight reduction of personal computers, frame 3 in such switches overlaps and tightly adheres to the upper portion of the membrane switch 2. As a result, even when free motion range limiter 13 outside wall surface 13*b* is extended and key top 5 bottom surface contacts the upper surface of frame 3, the overall key switch thickness cannot be brought below the sum of key top 5 height (including the side hanging portion 24) and the respective thickness of frame 3, membrane switch 2, and reinforcing base plate 1, thus limiting the ability to reduce key switch thickness or height further.

Another disadvantage is that although the spreading width W of free motion range limiter 13 is only slightly larger than the width of slider 20. However, a substantial amount of lengthwise space is required so as to allow key top 5 to make contact with the top surface of frame 3 when key top 5 is fully depressed. As a result of this substantial lengthwise space in free motion limiter 13, when key top 5 is depressed the direction of movement for key top 5 differs depending on whether the force applied to key top 5 is exerted towards a the keyboard operator or away from the keyboard operator. In other words, key top 5 makes undesirable movements in the frontward or backward direction depending on the degree of force exerted by the keyboard operator when pressing down on a key top.

SUMMARY OF THE PRESENT INVENTION

Accordingly, the object of the present invention is to eliminate some of the disadvantages found in the prior art and to provide a low profile key switch structure that is substantially reduced in height so as to reduce the thickness of personal notebook computer or the like. Another object of the present invention is to provide a key switch structure that minimizes undesirable key top movement that occurs when the key is depressed and which varies depending on the direction of the force that is exerted on the key top at that time.

In general, the first aspect of the present invention features a key switch structure that includes, a key top, a click rubber having a resilient force that pushes the key top upward when the key top is depressed and a membrane switch which disposed under the click rubber. This key top switch structure also includes a reinforcing base plate disposed on the bottom of the key switch structure, a pair of stabilizers disposed between the reinforcing base plate and the bottom surface of the key top wherein the pair of stabilizers are arranged so that there is one stabilizer on each side of the click rubber and a pair of stabilizer holders are formed at opposing ends of the bottom of the key top so that each stabilizer holder can hold one top end of each stabilizer.

This invention further includes a pair of frames that are arranged so that each said frame supports one stabilizer, a pair of top free motion range limiters are each formed between the stabilizer holder and the key top for each stabilizer wherein the top free range motion limiter is further formed to enclose a first top end and a second top end of each stabilizer therein in a free fitting manner. Similarly, the key switch structure of the present invention further includes a pair of bottom free motion range limiters are formed on each frame so that the bottom of each free motion range limiter engages with and is affixed to a free range limiter engagement section wherein the free motion range limiting engagement section is formed within the reinforcement base plate. The pair of bottom free-range motion limiters is further formed to enclose a first bottom end and a second bottom end of each stabilizer therein in a free fitting manner. The frame and the membrane switch are affixed on the reinforcing base plate so that the frame and the membrane switch do not overlap.

Embodiments of the invention may include one or more of the following features: a key switch structure wherein the first and second top ends and the first and second bottom ends of each of the stabilizers have sliders that projects perpendicularly therefrom so as to be enclosed in the pair of top free motion range limiters and the pair of bottom free motion range limiter.

Another embodiment may include a key switch structure, wherein each stabilizer is formed by two flat pieces that are joined at an intermediary point using an intermediary support axis so as to provide each stabilizer with a variable crossing angle that varies with the vertical movement of the key top.

Another embodiment may include a key switch structure, wherein a pair of top free motion range limiters and a bottom pair of free motion range limiters include a front and a rear free motion range limiter.

Another embodiment may include a key switch structure, wherein the slider of the first top end and the first bottom end of each stabilizer are allowed to rotate within each the front free motion range limiters and wherein the slider of each second top end and the second bottom end of each stabilizer is formed so as to allow the slider to rotate and slide within each rear free motion range limiters.

Another embodiment may include a key switch structure, wherein the key top further includes a convex section that protrudes downward from the bottom side of the key top and that is formed to fit that top portion of the click rubber.

Another embodiment may include a key switch structure, wherein the key top further includes a pair of engagement parts that project downward from the bottom side of opposing ends of the key top. Each engagement part has a protuberance that projects from its bottom that supports the stabilizer holder.

Another embodiment may include a key switch structure, wherein the free motion range engagement limiting section further includes a set of three vertical walls that limit the range of sliders on the bottom of each stabilizer.

Another embodiment may include a key switch structure, wherein the free motion range engagement limiting section further includes a pair of support columns that engage each frame.

Another embodiment may include a key switch structure, further includes notches that are formed in each frame to enclose sliders that engage each the frame.

Another embodiment may include a key switch structure, further includes notches that are formed on the reinforcement base plate to enclose the bottom end of the flat piece of each stabilizer.

Another embodiment may include a key switch structure, further includes a concave section that is formed to engage the engagement parts when the key top is depressed so that the engagement parts do not make contact with the membrane switch or frame.

The above advantages and features are of representative embodiments only. It should be understood that they are not to be considered limitations on the invention as defined by the claims.

BRIEF DESCRIPTION OF THE DRAWINGS

The features and advantages of the present invention will become apparent in the following detailed description and accompanying drawings in which like references denote like or corresponding parts, and in which:

FIG. 7 depicts a conventional key switch.

FIG. 7 specifically shows the stabilizer portion of a conventional key switch.

DETAILED DESCRIPTION

The objective of the present invention is to provide an improved low profile key switch that utilizes major portions of conventional key switches that will provide a reduction in height and superior operability. In order to achieve this objective, the free motion range limiters that enclose the stabilizer ends are made integral to the frame such that the free motion range limiters are formed in the frame. Moreover, the frame is made such that it can fit into or embedded in the reinforcing base plate so as reduce the thickness of the key switch structure.

Figure 1:
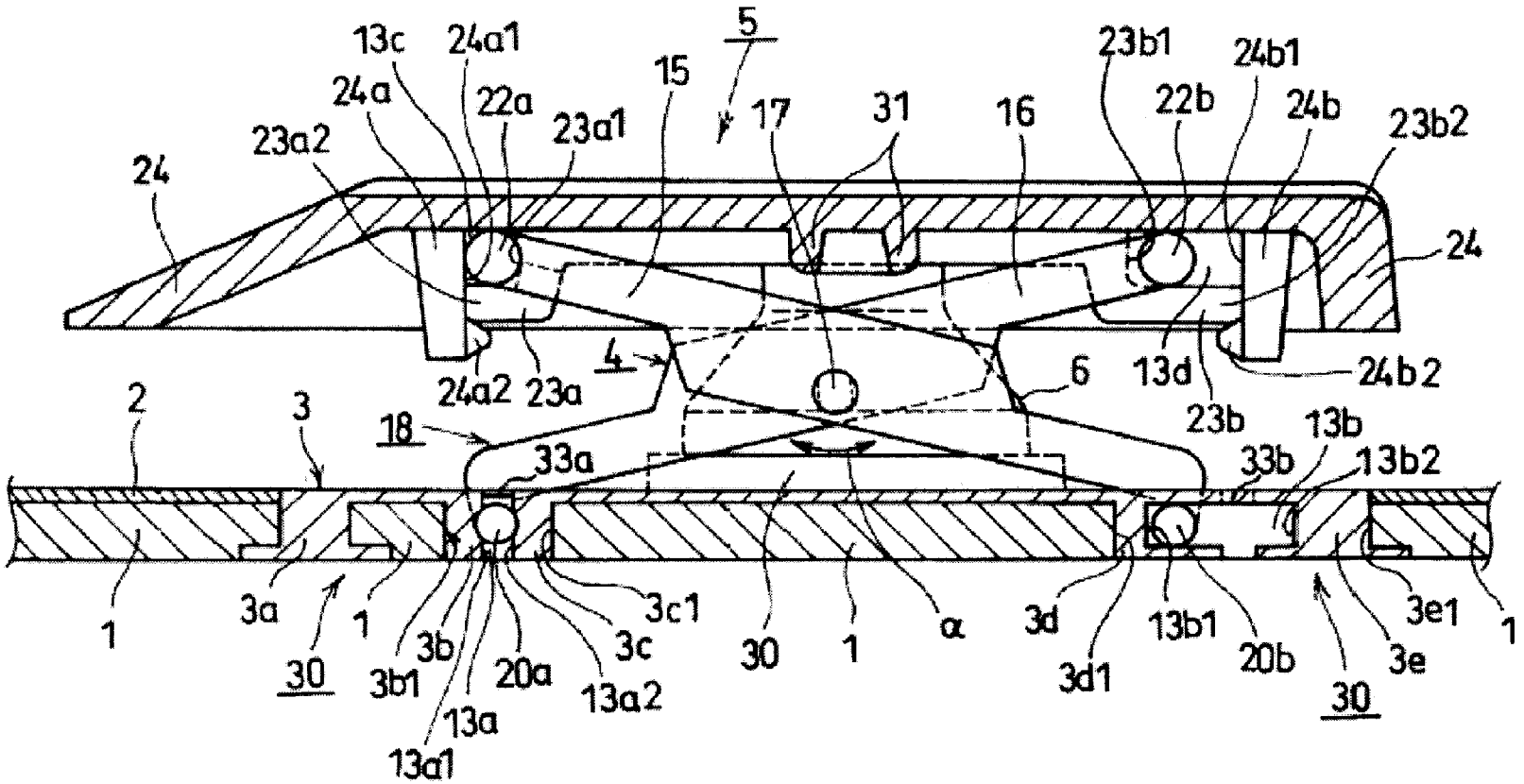
FIG. 1 shows a side view of a key switch structure of the present invention wherein the key switch is in the OFF state.
Figure 2:
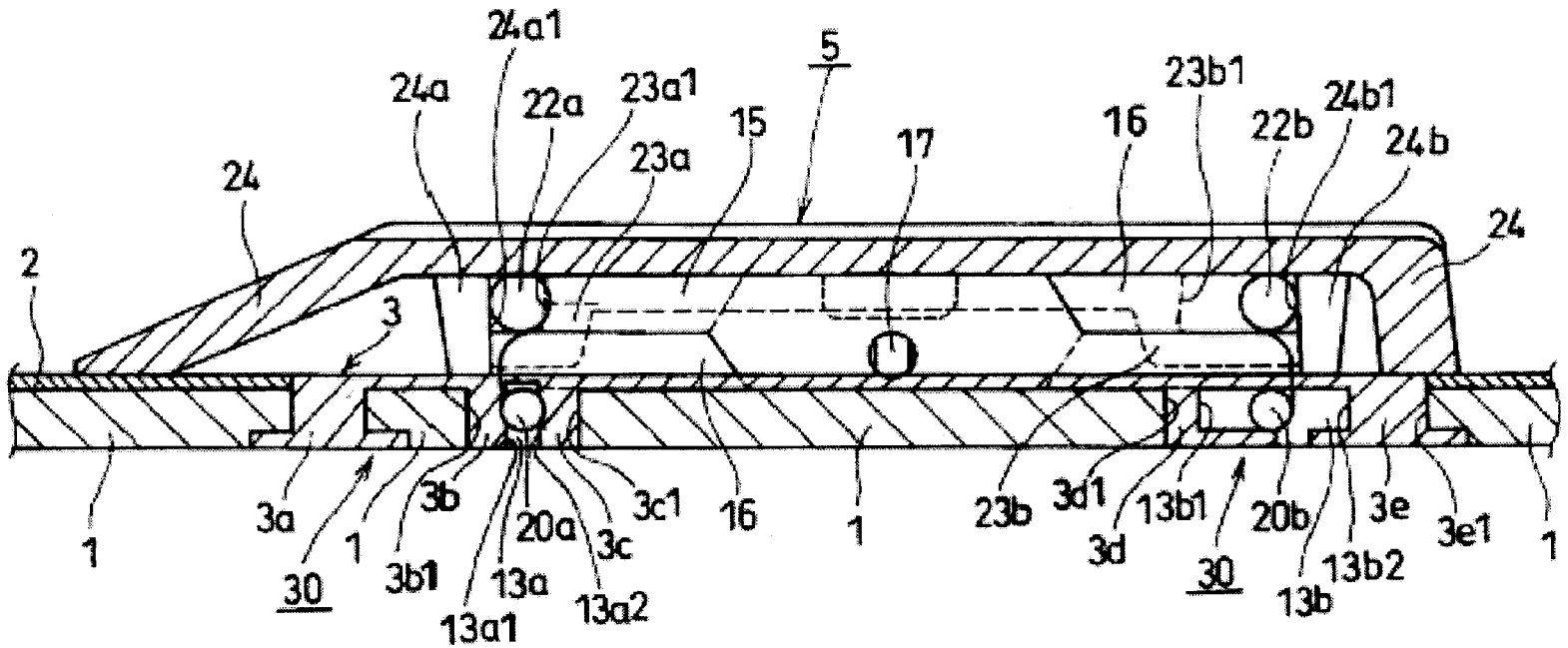
FIG. 2 shows a side view of a key switch structure of the present invention wherein the key switch is in the ON state.
Figure 3:
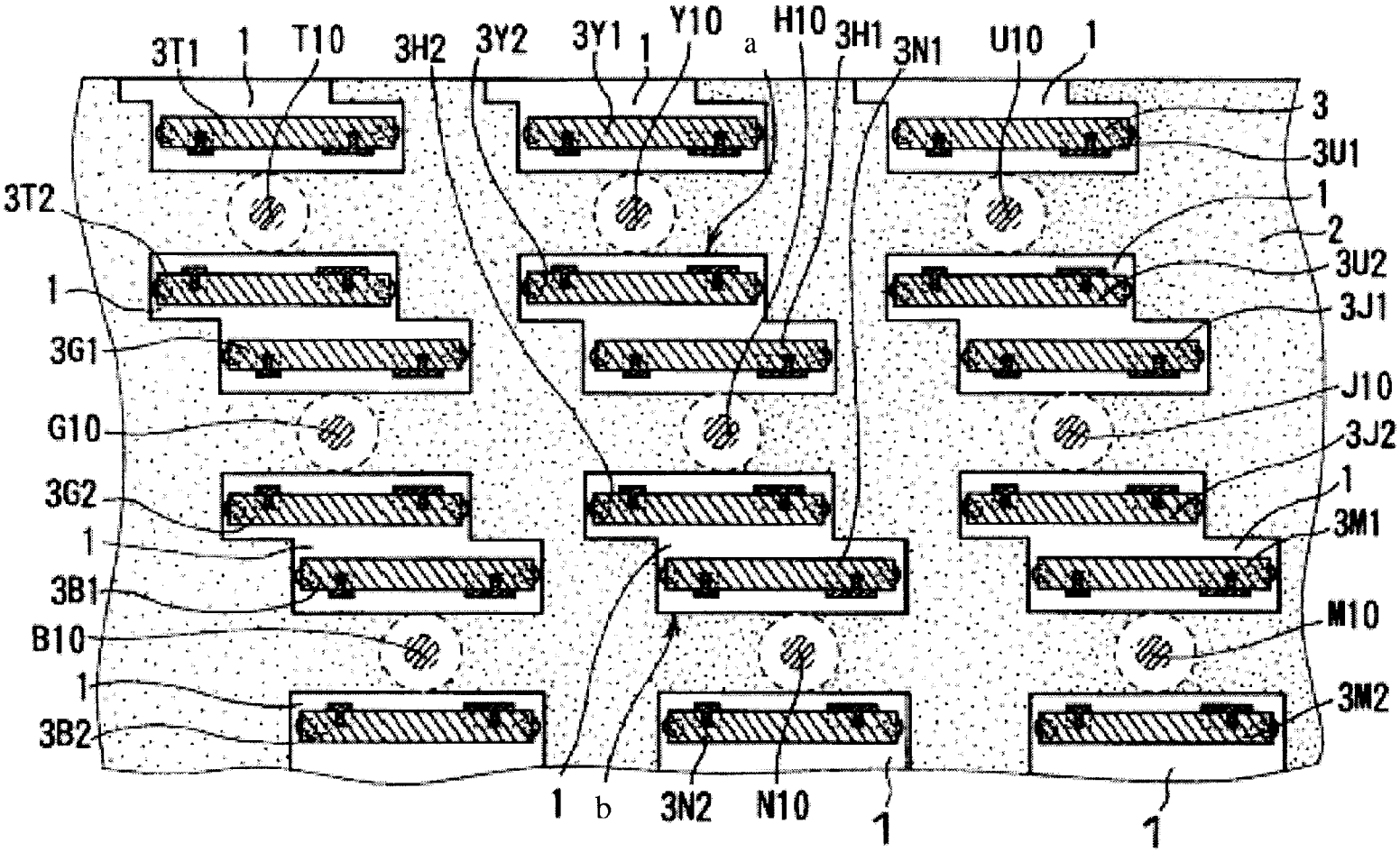
FIG. 3 shows a partial top surface diagram of a keyboard having multiple key switch structures that are configured as disclosed in the present invention.
Figure 4:
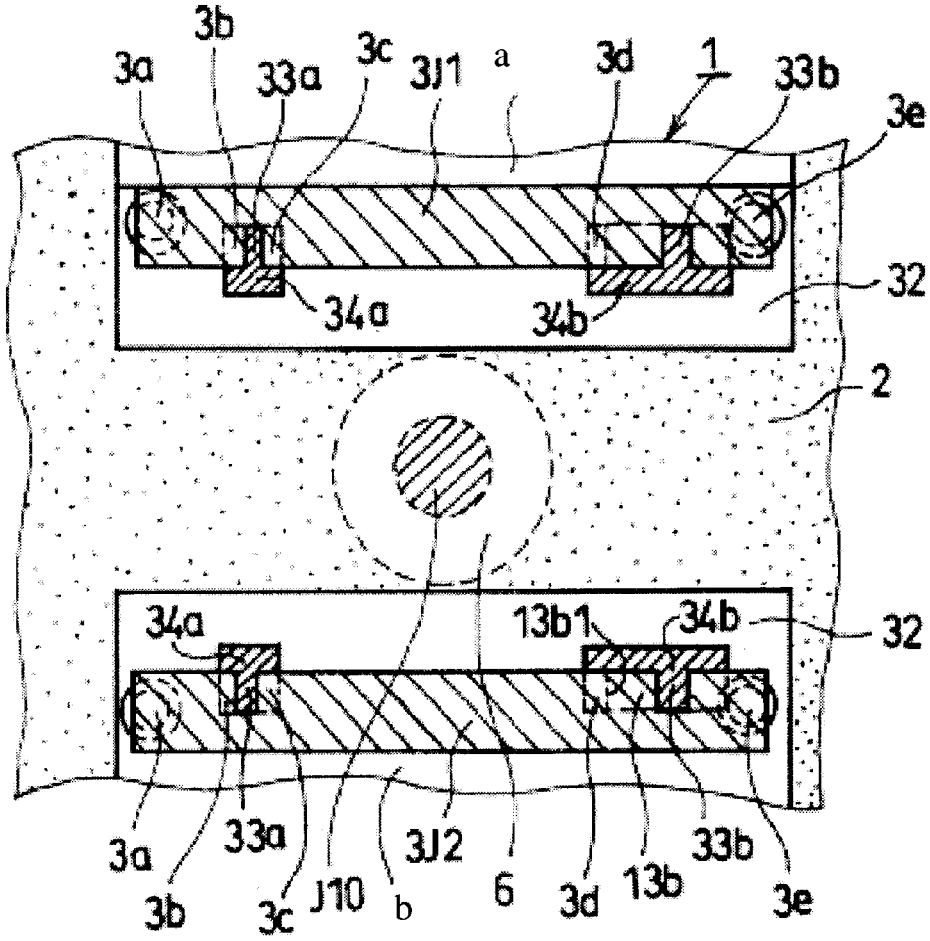
FIG. 4 shows an expanded top surface diagram of one key switch structure as shown in FIG. 3.
Figure 5:
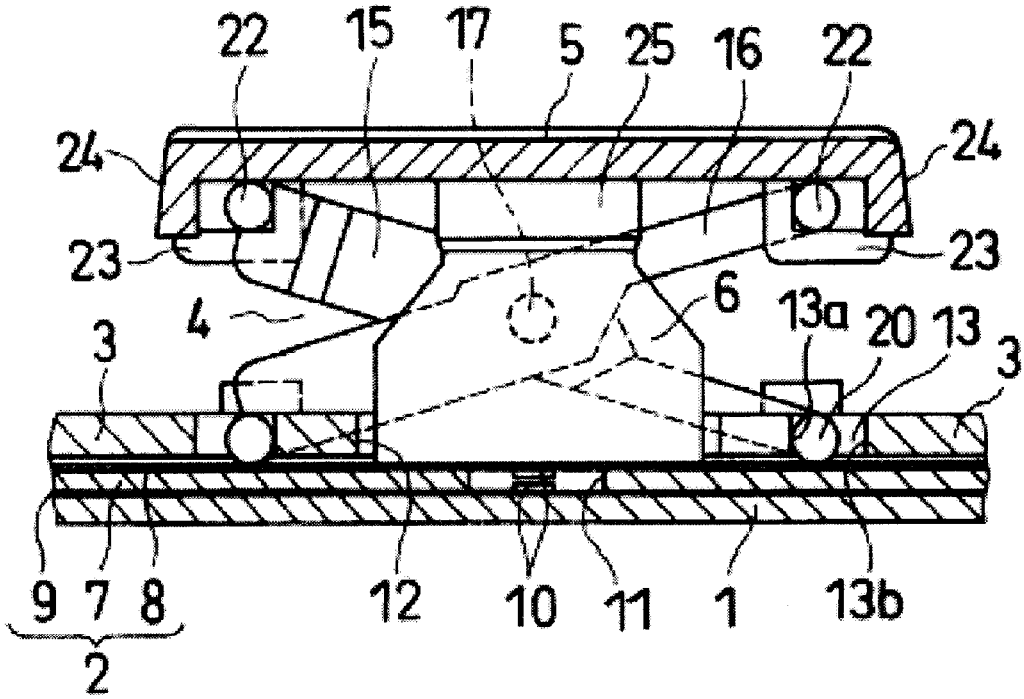
FIG. 5 shows a vertical cross sectional view through A—A in FIG. 7.
Figure 6:
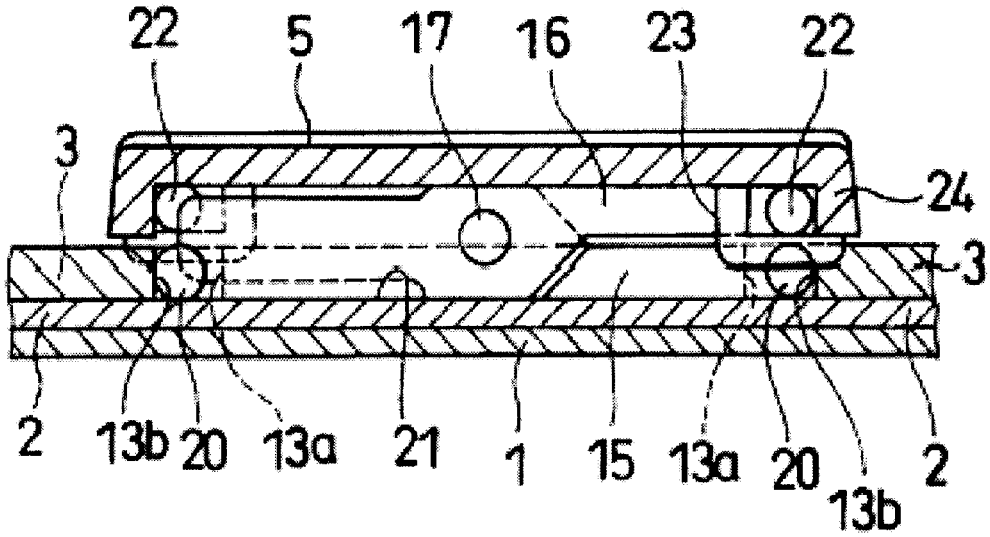
FIG. 6 shows a vertical cross sectional view through B—B in the FIG. 7.
Figure 7:
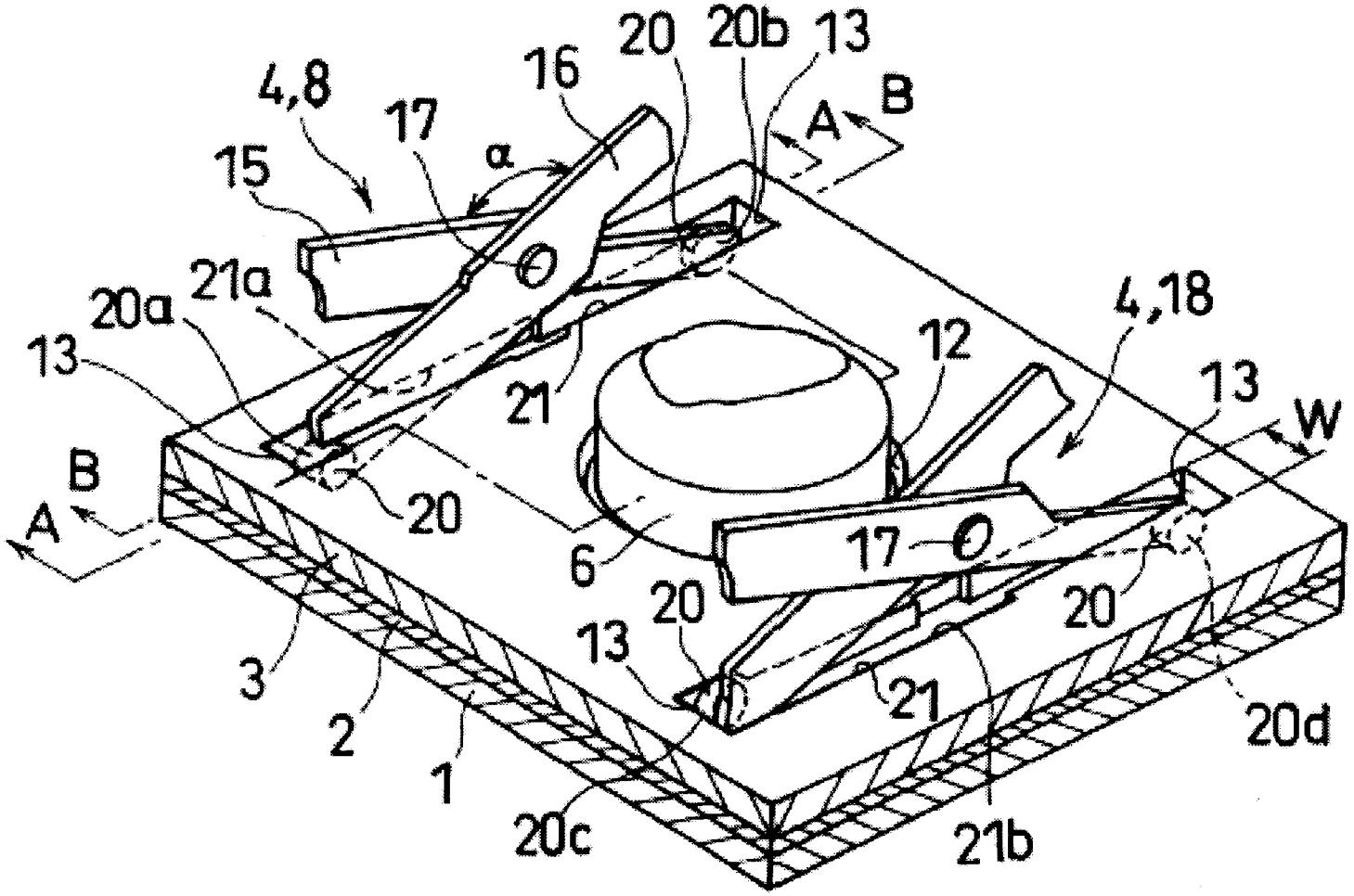
FIG. 7 depicts the structure of a convention key switch.

Referring to FIGS. 1–4, we provide detail descriptions of various embodiments of the low profile key switch structure disclosed in the present invention. FIGS. 5–7 refer to the prior art key switch. FIGS. 1 and 2 are diagrams of the right side as seen from the key switch operating position. FIGS. 3 and 4 are top views of membrane switch 2 and frame 3, and an expanded view of a portion thereof, respectively. In each of the figures, the same reference numerals are used for those parts that function in the same manner as those in FIGS. 5 and 6. In the explanation which follows, stabilizer 4 and key top 5 structures are left-right symmetrical when viewed from the key switch operator's position. Therefore only one is explained and explanation of the other is omitted.

FIG. 1 shows a side view of the key switch structure disclosed in the present invention wherein the key switch is in the OFF state. In this state no electrical contact is made because key top 5 is not depressed. The key switch of FIG. 1 includes reinforcing base plate 1, membrane switch 2 and frame 3. Reinforcing base plate 1 is preferably made of a rigid material. Membrane switch 2 is positioned on and caused to adhere to reinforcing base plate 1. The key switch further includes stabilizer 4, key top 5 and click rubber 6. Click rubber 6 is positioned between the top surface of membrane switch 2 and the bottom surface of key top 5. Membrane switch 2 and frame 3 are disposed on top of reinforcing base plate 1 so as to form approximately the same surface. More specifically, only one of either membrane switch 2 or frame 3 actually contacts reinforcing base plate 1 because membrane switch 2 and frame 3 do not overlap. Using stabilizer 4 and click rubber 6, a click sensation is obtained while also providing the appropriate keystroke length for optimal operability.

Membrane switch 2 is a typical membrane switch and the membrane switch depicted in FIG. 1 is similar to the switch shown in FIG. 5. The membrane switch in FIG. 5 includes membrane layers 8 and 9, electrical contact 10 and spacer 7. Spacer 7 and membrane layers 8 and 9 are omitted from FIGS. 1 and 2. Membrane switch 2 is preferably made of a flexible film material or the like.

FIG. 1 also shows key top 5. Key top 5 includes convex section 31 that is formed to fit the tip of click rubber 6. Click rubber 6 is concentrically shaped and positioned above the electrical contact (not shown). Hanging portion 24 is formed facing downward around key top 5, and engaging parts 24*a* and 24*b*, which engage stabilizer holders 23*a* and 23*b*, and which in turn hold sliders 22*a* and 22*b*, are formed on the inside thereof. Structures of the stabilizer holders 23*a* and 23*b*, and of the engaging parts 24*a* and 24*b* are as described below.

Sliders 22*a* and 22*b* at the top end of stabilizer 4 project perpendicularly from each side. Sliders 22*a* and 22*b* freely move within free motion range limiters 13*c* and 13*d* in which sliders 22*a* and 22*b* are enclosed by stabilizer holders 23*a* and 23*b* and engaging parts 24*a* and 24*b*. More specifically, slider 22*a* at one end of the stabilizer 4 is enclosed so as to be rotatable within the free motion range limiter 13*c* that is formed between the engaging part 24*a* and the stabilizer holder 23*a* vertical portion 23*a*1. Similarly, slider 22*b* at the top end of stabilizer 4 is enclosed so as to be able to rotate and slide within free motion range limiter 13*d* that is formed between engaging part 24*b* and stabilizer holder 23*b* vertical portion 23*b*1. Stabilizer holders 23*a* and 23*b* are such that their horizontal portions 23*a*2 and 23*b*2 are prevented from moving by protuberances 24*a*2 and 24*b*2 provided on the end of engaging parts 24*a* and 24*b*. This movement is specifically prevented when key top 5 and stabilizer 4 are depressed.

More specifically, slider 22*a* at one of the top ends of stabilizer 4 is enclosed so that it is allowed to rotate when moving between vertical portion 24*a*1 of engaging part 24*a* and the vertical portion 23*a*1 of the stabilizer holder 23*a*. The gap between vertical portions 23*a*1 and 24*a*1 is formed to be approximately equal to the diameter of slider 22*a* and is designed such that slider 22*a* at one end of the stabilizer 4 is allowed to rotate. Similarly, slider 22*b* at the other top end of stabilizer 4 is enclosed so as to be able to rotate and slide within the range of the engaging part 24*b* vertical component 24*b*1 and the stabilizer holder 23*b* vertical portion 23*b*1.

Concave section 32 is shown in FIG. 4. Concave section 32 is provided so that the ends of engaging parts 24*a* and 24*b* do not contact membrane switch 2 or frame 3 when key top 5 is depressed to its lowest point. Moreover, the bottom surface of the hanging portion 24 of key top 5 is formed so as not to contact membrane switch 2 and frame 3 when key top 5 is depressed to its lowest point, as shown in FIG. 2.

Stabilizer 4 of the present invention is disposed and affixed on the left and right of click rubber 6 (left and right when viewed from the key switch operating position) and is similar to stabilizer 4 shown in FIG. 5. X-shaped part 18 of the present invention which form stabilizer 4 is also similar to stabilizer 4 parts shown in FIG. 5. Moreover, stabilizer 4 of the present invention is formed of X-shaped part 18 in which two long, narrow flat pieces 15 and 16 are linked at an intermediary point by a support axis 17 that provides the stabilizer with a variable crossing angle $\alpha$. Pieces 15 and 16 may be made of a rigid material such as metal, hard plastic or the like. Sliders 20*a* and 20*b* are circular and protrude perpendicularly from the bottom ends of X-shaped part 18. Sliders 20*a* and 20*b* are enclosed inside of free motion range limiters 13*a* and 13*b* that are formed on frame 3. Sliders 20*a* and 20*b* fit loosely within free motion range limiters 13*a* and 13*b*. Free motion range limiters 13*a* and 13*b*, as shown in FIGS. 1–4 are formed such that sliders 20*a* and 20*b* do not jump out of free motion range limiters 13*a* and 13*b*.

Free motion range limiter 13*b* has sufficient space in the front-to-rear or lengthwise direction over a range described below, even when it encloses slider 20*b*. Slider 20*b* can move freely while rotating and sliding within free motion range limiter 13*b*. In contrast, free motion range limiter 13*a* does not have space to allow sliding in the lengthwise direction when enclosing slider 20*a*. Slider 20*a* is capable of rotating within free motion range limiter 13*a*.

As described above, in stabilizer 4, one of the pair of sliders at the front end, namely sliders 20*a* and 22*a* which are enclosed are allowed to rotate, while the other pair at the rear end, namely sliders 20*b* and 22*b* are also enclosed but in addition to rotate these sliders also slide. As a result, when key top 5 is depressed, slider 22*a* and slider 20*a* rotate within a fixed position. Similarly, slider 22*b* and slider 20*b* move while rotating and sliding when stabilizer 4 is compressed or collapsed downward. More specifically, the direction of movement of key top 5 is fixed. For example, when free motion range limiter 13*a* is placed in a position close to the keyboard operator, or when free motion range limiter 13*b* is placed in a position far from the keyboard operator, the direction of movement of key top 5 is fixed in a direction going away from the keyboard operator. Thus, an uncomfortable key operating position can be avoided.

Click rubber 6 is made of soft rubber and has an inverted funnel shape. As mentioned above, the top of click rubber 6 fits between convex section 31 on the underside of the key top. The bottom portion of click rubber 6 is positioned on the membrane switch 2 and positioned concentrically with respect to the electrical contact (not shown). Click rubber 6 barely deforms under the weight of key top 5 and stabilizer 4 alone, but when compressed by normal key operation it does in fact deform. At the time of compression click rubber 6 has an elasticity that provides the appropriate click sensation to the finger operating key top 5. Moreover, a known switch pushing component may be used which will cause membrane switch 2 to distort in a downward position when key top 5 is depressed.

As shown in FIG. 1, free motion range limiters 13*a* and 13*b*, which enclose the stabilizer 4 bottom-end sliders 20*a* and 20*b* in a free-fitting state are formed on the frame 3. Vertical walls 3*b*, 3*c*, and 3*d*, which respectively limit the range of free motion of sliders 20*a* and 20*b* at the bottom end of stabilizer 4 are formed on free motion range limiters 13*a* and 13*b*. Free motion range limiters 13*a* and 13*b* are inserted and secured to free motion range limiting engagement section 30 that is formed in reinforcing base plate 1 by press fitting. Moreover, support columns 3*a* and 3*e* are inserted and secured to free motion limiting section 30 in reinforcing base plate 1 by press fit engagement. Flange portions of support columns 3*a* and 3*e* may be formed using a heat press, fusion or another conventional method. Support columns 3*a* and 3*e* are provided on the each side of support axis 17 of stabilizer 4. Slider 20*a* on stabilizer 4 is enclosed by vertical walls 3*b* and 3*c* that form free motion range limiter 13*a* in such a way that slider 20*a* contacts the vertical portions 13*a*1 and 13*a*2 and is able to freely rotate.

The gap between vertical walls 3*b*, 3*c* is formed to be slightly smaller than the diameter of stabilizer 4 bottom-end slider 20*a* and is configured such that slider 20*a* is rotatable when fit into free motion range limiting engagement section 30 described below. Stabilizer 4 bottom-end slider 20*b* is enclosed in such a way as to be able to rotate and slide over an allowable range within free motion range limiter 13*b*. After support columns 3*a*, 3*e* and vertical walls 3*b*, 3*c*, and 3*d* have been inserted into free motion range limiting engagement section 30 the ends of support columns 3*a*, 3*e*, and vertical wall 3*d* are pressed down by a predetermined method and fused to free motion range limiting engagement section 30.

FIG. 3 shows is a partial top view of frame 3 and membrane switch 2 where the key switch of the present invention has been installed on a keyboard having a plurality of such key switch structures. More specifically, FIG. 3 depicts nine key switches that include T10, Y10, U10, G10, H10, J10, B10, N10, and M10. Sliders 20*a* and 20*b* are configured to form a single key switch by means of the respective frames provided at the top and bottom of FIG. 3. For example, H10 constitutes a single key switch structure. Frames 3H1 and 3H2 each support stabilizer 4 and correspond to key switch structure H10. Key top 5 (not shown) may be depressed causing stabilizer 4 to collapse and key switch H10 to be set to the ON state. Each key switch is similarly configured.

Membrane switch 2 is formed so as to surround frame 3. Frame 3 and membrane switch 2 are affixed to and arranged on the reinforcing base plate 1 so as not to overlap with one another. Frames 3Y2 and 3N2 correspond to key switches Y10 and N10 at the top and bottom of FIG. 3, respectively. Frames 3Y2 and 3N2 are surrounded by membrane switch 2. Moreover, frames 3H1 and 3Y2, and frames 3H2 and 3N2 are provided within the areas a and b, respectively. In portions of areas a and b where no frame is provided, concave section 32 (see FIG. 4) is formed such that the ends of engaging parts 24*a* and 24*b* do not contact the membrane switch 2 or frame 3 when stabilizer 4 is collapsed to the bottom and it has a crossing angle $\alpha$ of 180 degrees.

Because frame 3 and membrane switch 2 are positioned to adhere to reinforcing base plate 1 in such a way that they do not mutually overlap, it is possible to form the top surface of membrane switch 2 and frame 3 at approximately the same height. Moreover, the area surrounding frame 3 may be preferably designed to surround two frames. However, if the requirement that the ends of the engaging parts 24*a* and 24*b* do not make contact membrane switch 2 and frame 3 is satisfied, the surrounding area may also be otherwise designed. For example, an acceptable design alternative is to have membrane switch 2 surrounds a single frame instead of two frames as depicted.

FIG. 4 shows is an expanded top surface diagram of frames 3J1 and 3J2 and membrane switch 2 for a single key top. More specifically, FIG. 4 shows an expansion of the key switch J10 area in FIG. 3. Key switch J10 is configured in a similar manner as the other key switches. Key switch J10 is formed on the membrane switch 2 by a conventional method. The push component associated with click rubber 6 (not shown) pushes against membrane 2 on an electrical contact such that membrane 2 is deformed and as a result of such deformation the electrical contact is closed.

Frames 3J1 and 3J2 are formed within the areas a and b, respectively and are surrounded by membrane switch 2. Within areas a and b convex section 32 is formed in the space where frames 3J1 and 3J2 are not provided. Concave section 32 is lower then the level of frame 3 by appropriately the same as the combined height of frame 3 and membrane 2. The frames 3J1 and 3J2 are symmetrical with respect to the key switch J10. Therefore, the structure and operation of both frames are identical, so only frame 3J2 will be described below.

As shown in FIG. 4, notches 33*a* and 33*b* are provided on frame 3J2 and are used to enclose sliders 20*a* and 20*b* of stabilizer 4 in a free-fitting state within free motion range limiters 13*a* and 13*b*. Notch 33*b* is formed on frame 3J2 such that when stabilizer 4 is depressed to its lowest position and slider 20*b* moves by rotation and sliding within the free motion range limiter 13*b*, slider 20*b* does not reach the notch 33*b*. The notch 33*a* is formed to be approximately the same or slightly smaller than the vertical walls 3*b* and 3*c* which limits the movement of slider 20*a*.

Free motion range limiters 13*a* and 13*b* are formed at the bottom of notches 33*a* and 33*b*, respectively. Notch 33*a* is formed such that when slider 20*b* is caused to contact the inner wall surface 13*b*1 of free motion range limiter 13*b* with stabilizer 4 raised to the highest point and slider 20*a* is in the position at the bottom of notch 33*a*.

Notches 34*a* and 34*b* are formed on the reinforcing base plate 1 so as to penetrate the reinforcing base plate 1. Moreover, notches 34*a* and 34*b* are rectangular in shape and have a size that is same or larger than the width of the bottom end of the flat piece 15 of stabilizer 4. The bottom ends of the flat pieces 15 are enclosed in notched 34*a* and 34*b*, respectively.

In the present invention, stabilizer 4 may be pushed down to the lowest position, and slider 20*b* is inserted from notch 33*b* into the free motion range limiter 13*b*. As a result, flat piece 15, which is the lower end portion of stabilizer 4 is enclosed in the notch 34*b*. When, in this position, the slider 20*a* is inserted into the notch 33*a* and enclosed so as to be rotatable, the bottom end of stabilizer 4 flat piece 16 is enclosed in the notch 34*a*. As described above, notch 33*a* is formed such that it lies at the position of slider 20*a* when stabilizer 4 is raised to the highest position and the slider 20*b* is moved to a position at which it contacts inside wall surface 13*b*1 of free motion range limiter 13*b*. As a result, when the stabilizer 4 is collapsed down to its lowest position, and slider 20*b* has moved by rotation or sliding inside free motion range limiter 13*b* slider 20*b* will not reach the notch 33*b*. Accordingly, slider 20*b* will not separate from free motion range limiter 13*b*.

Free motion range limiting engagement section 30 is formed on the reinforcing base plate 1 as described below. Frame 3J2 is caused to tightly adhere to the top surface of the reinforcing base plate 1. One method of adhesion may be to fuse frame 3J2 to reinforcement base plate 1. Penetrating holes (not shown), are formed in the reinforcing base plate 1 at the position where frame 3J2 support columns 3*a* and 3*e* and vertical walls 3*b*, 3*c*, and 3*d* are formed. The penetrating holes have approximately the same dimension as the frame 3J2 support columns 3*a* and 3*e* and vertical walls 3*b*, 3*c*, and 3*d*. These penetrating holes are referred to as free motion range limiting engagement section 30. Frame 3J2 support columns 3*a* and 3*e* and vertical walls 3*b*, 3*c*, and 3*d* are inserted into the respective sections of free motion range limiting engagement section 30. The ends of the support columns 3*a* and 3*e* are then fused by heat or other means such that they have the same height as the surface of the bottom portion of reinforcing base plate 1. As a result, frame 3J2 fuses to the top of the reinforcing base plate 1, and frame 3 and membrane switch 2 are caused to adhere to the reinforcing base plate 1 in positions such that they do not mutually overlap. Therefore, the top surfaces of the membrane switch 2 and the frame 3 have approximately the same height.

As shown in FIG. 1, key top 5 is in the OFF, non-depressed state. In this state key top 5 is extended upward by the force of click rubber 6 causing the electrical contact push piece to be separated from the membrane switch 2. As result of this separation the electrical contact cannot conduct electricity and is therefore sets the switch to the OFF state. Moreover, in the OFF state X-shaped part 18 of stabilizer 4 is also in an extended position. At this point, slider 20*b* of X-shaped part 18 is in a position at which it contacts inside wall surface 13*b*1 of free motion range limiter 13*b* and slider 22*b* is in a position at which it contacts stabilizer holder 23*b* vertical portion 23*b*1. The pair-forming slider 22*b* and slider 20*b* come into contact with the vertical portions, and no further upward deflection of stabilizer 4 and the attached key top 5 may occur.

When key top 5 is depressed by a key operation in this state, the downward pushing force compresses and distorts click rubber 6, while at the same time exerting a downward force on stabilizer 4. By this means, X-shaped part 18 of stabilizer 4 opens such that the crossing angle a increases, leaving stabilizer 4 in a collapsed or compressed state. Finally, stabilizer 4 reaches a folded state in which crossing angle $\alpha$ reaches approximately 180 degrees, as shown in FIG. 2. At this point, slider 20*b* of X-shaped part 18 is closer in position to the inside wall surface 13*b*1 than notch 33*b*, and slider 22*b* is in a position at which it contacts key top 5 engaging part 24*b* side surface 24*b*1, so that further displacement is prevented. Even when key top 5 is at a midpoint position in the process of depressing key top 5, stabilizer 4, by its rigidity, prevents sideways deflection of key top 5 and stabilizes its posture.

Before slider 20*b* and slider 22*b* reach the free motion limit position, the push section associated with click rubber 6 pushes on and deforms membrane switch 2 downward over the electrical contact causing the contact to close. When a finger operating the key leaves key top 5 removing downward force, key top 5 rises due to click rubber 6 resilient forces. Stabilizer 4 which is connected to key top 5 is then extended upward causing and the whole key switch structure to return to the OFF state, as shown in FIG. 1.

As described above, membrane switch 2 and frame 3 are provided on approximately the same surface, so that when stabilizer 4 reaches a folded state with a final crossing angle $\alpha$ of 180 degrees, the bottom surface of key top 5 hanging portion 24 will not contact either membrane switch 2 or frame 3.

In accordance with one embodiment of the present invention the height of a key switch may be reduced further when the frame and membrane switch structures that are provided on a reinforcing base plate are arranged and affixed to the reinforcing base plate in such a way as not to mutually overlap. A free motion range limiter that encloses slider 22 in a free-fitting state is formed on the stabilizer holding piece under the key top. Moreover, the free motion range limiter formed on the frame is inserted in and affixed to the free motion range limiting engagement section that is formed on the reinforcing base plate. Thus, allowing a reduction in the overall key switch height.

Further, in accordance with one embodiment of the prevent invention, the undesirable key top movement caused by the force and direction in which the key top is pressed is substantially eliminated. In the foregoing description, the apparatus of the present invention has been described with reference to specific examples. It should be understood and expected that variations in the principles of the apparatus herein disclosed may be made by one skilled in the art and it is intended that such modifications, changes, and substitutions are to be included within the scope of the present invention as set forth in the appended claims. The specification and drawings are accordingly to be regarded in an illustrative rather than restrictive sense.

What is claimed is:

1. A key switch structure comprising:

a key top;

a click rubber having a resilient force that pushes said key top upward when said key top is depressed;

a membrane switch arranged so that at least a portion of said membrane switch is disposed under said click rubber;

a reinforcing base plate disposed on the bottom of said key switch structure;

a pair of stabilizers disposed between said reinforcing base plate and the bottom surface of said key top wherein said pair of stabilizers are arranged so that there is one said stabilizer on each side of said click rubber;

a pair of stabilizer holders are formed at opposing ends of the bottom of said key top so that each said stabilizer holder can hold one top end of each said stabilizer;

a pair of frames that are arranged so that each said frame supports one said stabilizer;

a pair of top free motion range limiters are each formed between said stabilizer holder and said key top for each said stabilizer wherein said top free motion range limiter is further formed to enclose a first top end and a second top end of each stabilizer therein in a free fitting manner;

a pair of bottom free motion range limiters are formed on each said frame so that each said bottom free motion range limiter is embedded in and affixed to a free range limiter engagement section wherein said free motion range limiting engagement section is formed within said reinforcement base plate and said pair of bottom free motion range limiters are further formed to enclose a first bottom end and a second bottom end of each stabilizer therein in a free fitting manner; and said frame and said membrane switch are affixed on said reinforcing base plate so that said frame and said membrane switch do not overlap.

2. The key switch structure of claim 1, wherein said first and second top ends and said first and second bottom ends of each said stabilizer each have a slider that projects perpendicularly therefrom so as to be enclosed in said pair of top free motion range limiters and said pair of bottom free motion range limiters.

3. The key switch structure of claim 2, wherein said pair of top free motion range limiters and said bottom pair of free motion range limiters include a first and a second free motion range limiter.

4. The key switch structure of claim 3, wherein said slider of said first top end and said first bottom end of each said stabilizer are allowed to rotate within each said first free motion range limiters and wherein said slider of each said second top end and said second bottom end of each said stabilizer are allowed to rotate and slide within each said second free motion range limiter.

5. The key switch structure of claim 2, wherein said free motion range engagement limiting section further comprises a plurality of vertical walls that limit the range of said sliders on the bottom of each said stabilizer.

6. The key switch structure of claim 1, wherein each said stabilizer is formed by two flat pieces that are joined at an intermediary point using an intermediary support axis to form an X-shape so as to provide each said stabilizer with a variable crossing angle that varies with the vertical movement of said key top.

7. The key switch structure of claim 1, wherein said key top further comprises a convex section that protrudes downward from the bottom side of said key top that is formed to fit that top portion of said click rubber.

8. The key switch structure of claim 1, wherein said key top further comprises a plurality of engagement parts that project downward from the bottom side of opposing ends of said key top each having a protuberance that projects from the bottom end of each said engagement part wherein said protuberance supports each said stabilizer holder.

9. The key switch structure of claim 8, further comprising a concave section that is formed to engage the bottom of said engagement parts when said key top is depressed so said engagement parts do not make contact with said membrane switch and said frame.

10. The key switch structure of claim 1, wherein said free motion range engagement limiting section further comprises a plurality of support columns that engage each said frame.

11. The key switch structure of claim 1, further comprising notches that are formed in each said frame to enclose said sliders that engage each said frame.

12. The key switch structure of claim 1, further comprising notches that are formed on said reinforcement base plate to enclose the bottom end of said flat piece of each said stabilizer.

13. The key switch structure of claim 1, wherein said membrane switch is caused to adhere to said reinforcement base plate.

14. The key switch structure of claim 1, wherein said pair of frames is caused to adhere to said reinforcement base plate.

15. The key switch structure of claim 1, wherein said membrane switch surrounds said pair of frames.

16. The key switch structure of claim 1, wherein said membrane switch surrounds one said frame.

17. The key switch structure of claim 1, wherein said membrane switch and each said frame have substantially the same height relative to said reinforcing base plate.

18. The key switch structure of claim 1, wherein said key top further comprises a hanging portion that is formed from the edge of said key top so that it does not contact said membrane switch when said key top is fully depressed.

19. The key switch structure of claim 1, wherein said key top further comprises a hanging portion is formed from the edge of said key top so that it does not contact said frame when said key top is fully depressed.

* * * * *